US006663231B2

(12) United States Patent
Lee et al.

(10) Patent No.: US 6,663,231 B2
(45) Date of Patent: Dec. 16, 2003

(54) MONOLITHIC NOZZLE ASSEMBLY FORMED WITH MONO-CRYSTALLINE SILICON WAFER AND METHOD FOR MANUFACTURING THE SAME

(75) Inventors: Eun-sung Lee, Taejeon (KR); Hyun-cheol Kim, Seoul (KR); Yong-soo Oh, Seongnam (KR); Cimoo Song, Yongin (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 6 days.

(21) Appl. No.: 09/790,714

(22) Filed: Feb. 23, 2001

(65) Prior Publication Data

US 2001/0028378 A1 Oct. 11, 2001

(30) Foreign Application Priority Data

Feb. 24, 2000 (KR) ..... 2000-9103

(51) Int. Cl.[7] ..... B41J 2/045
(52) U.S. Cl. ..... 347/68
(58) Field of Search ..... 347/68, 47, 49, 347/70, 71, 94, 63, 54, 72–73, 9, 20; 310/357, 358, 359, 328, 324, 311, 330–335; 324/765; 29/25.35, 890.1; 239/601

(56) References Cited

U.S. PATENT DOCUMENTS 3,921,916 A 11/1975 Bassous ..... 239/601
6,217,158 B1 * 4/2001 Kanaya et al. ..... 347/70
6,411,017 B1 * 6/2002 Qiu et al. ..... 310/358
6,426,642 B1 * 7/2002 Akram et al. ..... 324/765
6,443,566 B1 * 9/2002 Watanabe et al. ..... 347/68
6,460,981 B1 * 10/2002 Yasukawa et al. ..... 347/70

FOREIGN PATENT DOCUMENTS

EP 0 659 562 A2 A3 6/1995

OTHER PUBLICATIONS

Babaei et al, an Integrable Nozzle for Monolitic Microfluidic Devices, Sensors and Actuators A65, 221–227, (1998).

* cited by examiner

*Primary Examiner*—Lamson Nguyen
*Assistant Examiner*—K. Feggins
(74) *Attorney, Agent, or Firm*—Lee & Sterba, P.C.

(57) ABSTRACT

A monolithic nozzle assembly formed with a mono-crystalline silicon substrate includes a damper for temporarily storing an incoming fluid, and a nozzle having a pyramidal portion and an outlet portion, the pyramidal portion for guiding the flow of the fluid from the damper toward the outlet portion and for increasing the pressure of the fluid, and the outlet portion through which the fluid is discharged, wherein the damper, and the pyramidal and outlet portions of the nozzle are aligned with each other and formed in the single mono-crystalline silicon substrate by continuous processes. The monolithic nozzle assembly can be formed with a single (100) mono-crystalline silicon wafer. Compared with a complicated nozzle assembly formed using a great number of silicon wafers and plates, the configuration of the monolithic nozzle assembly is simple, and can be manufactured on a mass production scale by semiconductor manufacturing processes.

3 Claims, 21 Drawing Sheets

MONOLITHIC NOZZLE ASSEMBLY FORMED WITH MONO-CRYSTALLINE SILICON WAFER AND METHOD FOR MANUFACTURING THE SAME

BACKGROUND OF THE INVENTION

1. Field of the Invention

The present invention relates to a monolithic nozzle assembly for fluid formed using a mono-crystalline silicon wafer, and a method for manufacturing the same by continuous self-alignment.

2. Description of the Related Art

A laminated ink jet recording head disclosed in EP 0 659 562 A2 is shown in FIG. 1A. As shown in FIG. 1A, the laminated ink jet recording head has a nozzle plate 101 with a nozzle 100, three plates 201*a*, 201*b* and 201*c* with communication holes, a plate 301 with a pressure producing chamber 300, and a vibration plate 400, which are stacked in sequence. Ink contained in an ink tank 800 flows through an inlet 700 into a reservoir chamber 600*a*, and is temporarily stored in the reservoir chamber 600*a*. As the ink flows through an ink inlet 600*c* and the communication hole 600*b* into the pressure producing chamber 300, the ink tank 800 fills with ink. A filter 900 for filtering the ink supplied from the outside is located on the top of the ink tank 800. The vibration plate 400 has piezoelectric vibration elements, so that a predetermined pressure can be applied to the ink filling the pressure producing chamber 300 according to a voltage signal applied to the piezoelectric vibration elements. As a result, ink is discharged out of the nozzle 100 through the communication holes 200*a*, 200*b* and 200*c*. The laminated ink jet recording head having the configuration needs align and bonding processes to combine each of the plates. As illustrated in FIG. 1B. a complicated assembling process is needed to combine each plate, which lowers yield and efficiency. Furthermore, an alignment error occurs during the alignment. In particular, the nozzle assembly indicated by "A" in FIG. 1A, including a damper serving as a flow path of fluid and nozzle, are formed by depositing the plates having different sized holes. The conventional nozzle assembly nozzle assembly, which effects a smooth fluid flow and discharge of ink droplets, is formed by depositing the individual plates. Thus, if the individual plates are misaligned, a directional smooth flow of fluid is not obtained.

The nozzle assembly can be manufactured in a variety of ways, as illustrated in FIGS. 2A through 2F, FIGS. 3 and 4, and FIGS. 5A through 5C. The illustrations of the drawings are limited to the formation of nozzles. Thus, additional deposition processes are needed to form a damper. These additional deposition processes are disadvantageous in terms of efficiency and yield, as described above.

In particular, FIGS. 2A through 2F illustrate a method for forming nozzles, which is disclosed in U.S. Patent No. 3,921,916. Referring to FIGS. 2A through 2C, a selective doping is performed on one surface of a substrate. Then, the opposite surface of the substrate is wet etched, as shown in FIG. 2D. During the wet etching, only the doped silicon is selectively etched, forming a nozzle part, as illustrated in FIGS. 2E and 2F. Limitation of this method are related to doping depth and overall processing complexity.

FIG. 3 illustrates a method for forming nozzles by mechanical punching. This method results in uneven cut surfaces and a low yield. In addition, the method is applicable only to the structure formed by deposition.

FIG. 4 illustrates a method of forming nozzles, which was described in an article by Jafar Haji Babaei, et al., entitled "An integrable nozzle for monolithic microfluid devices," published in Sensors and Actuators A, Vol. 65 (998), pp. 221–227. According to this method, the nozzle is formed by a two-side alignment and a time-controlled wet etching. The nozzle size is determined depending on the depth of etching and the feature size of a mask pattern used for wet etching. Thus, there is a problem of uniformity. It is inconvenient to stop the etching process by measuring time.

FIGS. 5A through 5C illustrate a method for forming nozzles, which was described in an article by G. Siewell, et al., entitled "The thinkjet orifice plate: A part with many functions," published in the Hewlett-Packard Journal, Vol. 36, No. 5, (May 1985), pp. 33–37. In particular, a photoresist pattern is applied on a portion of the substrate, as illustrated in FIG. 5A. Then, nickel (Ni) is deposited on the structure exclusive of a pattern deposited portion to be nozzles by electroplating, as illustrated in FIG. 5B. Then, the Ni plated layer is separated from the substrate, as illustrated in FIG. 5C, thereby completing a nozzle part. The size of nozzles formed through this method varies in the range of a few microns, and the tilt angle of the nozzle part cannot be accurately adjusted.

FIGS. 6A and 6B, and FIGS. 7A through 7D illustrate conventional methods for manufacturing a nozzle assembly by combining two silicon wafers each having a damper and nozzle part made of silicon. Referring to FIGS. 6A and 6D, a bulk silicon wafer 20 having a damper 21 is attached to a nozzle plate 30 having a nozzle opening 31 to form a nozzle assembly. In another method, referring to FIG. 7A, first a damper 42 is formed in a bulk silicon wafer 40. Then as illustrated in FIG. 7B, a wet etch mask 42 is deposited on the sidewalls of the damper 41, and a nozzle plate 50 is prepared. The bulk silicon wafer 40 is stacked on the nozzle plate 50, as illustrated in FIG. 7C. Then, as shown in FIG. 7D, the portion of the nozzle plate 50, which is exposed through the damper 41, is wet etched to form a nozzle opening 51.

For both of the methods described above, a thin wafer is used as the nozzle plates 30 and 50, so that careful handling is required to keep the thin nozzle plates 30 and 50 from breaking. The method illustrated in FIGS. 6A and 6B needs a damper-to-nozzle alignment in combining the bulk silicon wafer 20 and the nozzle plate 30. Although the method described with reference to FIGS. 7A through 7D requires no alignment, there is a problem of handing two separated fragile wafers.

FIGS. 8A through 8C illustrate a nozzle structure formed using the characteristic of the crystal planes of silicon by wet etching. In particular, FIG. 8A illustrates the crystal planes of silicon. The etch rate of the (111) silicon plane in an etchant such as trimethylammonium hydroxide (TMAH) is slower than the (100) silicon plane. As a result, the (100) silicon plane is etched, as shown in FIGS. 8B and 8C.

FIG. 9 illustrates the formation of a nozzle structure by dry etching. As illustrated in FIG. 9, because the thickness of a coated layer is not uniform over the structure, i.e., because the coated layer is thicker at the trench sidewall portion c than at the portion a, uniform dry etching with plasma is difficult.

In the nozzle assembly having a damper outlet and a nozzle, the nozzle guide controls the flow of a fluid for smooth discharge. Additionally, the nozzle serves as the outlet of a valve, or a deposition unit, such as printer heads. The damper outlet enables fluid to flow in a direction, and serves as an auxiliary discharging unit as well as a damper.

A conventional method for forming a stepped nozzle assembly having a nozzle and a damper outlet with a silicon wafer by a micro-electro mechanical system (MEMS), wherein a single step of the stepped structure has a height greater than tens of microns, is illustrated in FIGS. 10A through 10K. In particular, FIGS. 10A and 10B are sectional views of substrates for nozzle assemblies each having multiple steps. FIGS. 10C and 10D are sectional views illustrating problems in the manufacture of a nozzle assembly with such a multi-step configuration. For example, reference numeral 5 indicates a void 5 formed in a deep trench during deposition of a photoresist layer. FIGS. 10E through 10K are sectional views illustrating a method for manufacturing the nozzle assembly shown in FIG. 10A with multiple stepped masks.

For the nozzle assembly illustrated in FIG. 10A, a bulk silicon wafer 80 is prepared first, as shown in FIG. 10E. Following this, as shown in FIG. 10F, a first mask 60 is deposited on the bulk silicon wafer 80. As shown in FIG. 10G, a second mask 70 is deposited over the entire surface of the bulk silicon wafer 80. As shown in FIG. 10H, an aperture 71*a* for use in forming a damper is formed in the second mask 70. Then, as shown in FIG. 10I, the portion of the bulk silicon wafer 80 which is exposed through the aperture 71*a* is etched to form a damper 75. Then, as shown in FIG. 10J, the second mask 70 deposited on the top of the bulk silicon wafer 80 is removed. Then, the exposed portion of the bulk silicon wafer 80 is etched, resulting in a stepped configuration, as shown in FIG. 10K.

In the manufacture of a nozzle assembly having such a stepped configuration, it is difficult to uniformly deposit photoresist on a wafer. When a photoresist is deposited by spin coating, obtaining a uniform deposition of the photoresist is difficult due to centrifugal force. In addition, a void 5 is formed in a deep trench during deposition of photoresist, as shown in FIG. 10D. This void 5 causes breakage of the coated photoresist layer during a baking process. These problems occurring in the deposition of photoresist can be solved with multiple stepped masks, as described with reference to FIGS. 10E through 10K.

However, the method performed with such multiple stepped masks cannot be applied to form a conical nozzle as shown in FIG. 10B, because the first and second patterns need to be protected during etching into the third pattern, and the third pattern needs to be protected during etching into the first or second pattern. For this reason, the process performed with multiple stepped masks, which is described with reference to FIGS. 10E through 10K, cannot be applied to form a conical nozzle.

When a nozzle is formed as an outlet for fluid, there is.a need to perform hydrophilic or hydrophobic surface treatment around the nozzle. Conventional methods, such as those described above, render determination of the hydrophilic-and-hydrophobic boundary virtually impossible.

SUMMARY OF THE INVENTION

It is an object of the present invention to provide a monolithic nozzle assembly with a simple configuration, and a method for manufacturing the same, in which a nozzle assembly can be fully integrated in a single mono-crystalline silicon wafer by semiconductor manufacturing processes and MEMS process at a low cost.

According to an aspect of the present invention, there is provided a monolithic nozzle assembly formed with a mono-crystalline silicon substrate, comprising: a damper for temporarily storing an incoming fluid; and a nozzle having a pyramidal portion and an outlet portion, the pyramidal portion for guiding the flow of the fluid from the damper toward the outlet portion and for increasing the pressure of the fluid, and the outlet portion through which the fluid is discharged, wherein the damper, and the pyramidal and outlet portions of the nozzle are aligned with each other and formed in the single mono-crystalline silicon substrate by continuous processes.

It is preferable that the monolithic nozzle assembly further comprises a flow path through which the fluid is supplied into the damper, and a channel for connecting the flow path and the damper. Preferably, the mono-crystalline silicon substrate is the (100) mono-crystalline silicon substrate.

According to another aspect of the present invention, there is provided a method for manufacturing a monolithic nozzle assembly with a mono-crystalline silicon substrate by continuous self-alignment, the monolithic nozzle assembly including a damper for temporarily storing an incoming fluid, and a nozzle having a pyramidal portion and an outlet portion, the pyramidal portion for guiding the flow of the fluid from the damper toward the outlet portion and for increasing the pressure of the fluid, and the outlet portion through which the fluid is discharged outside, the method comprising: (a) depositing a first mask over the entire surface of a (100) mono-crystalline silicon substrate; (b) forming a first aperture in a portion of the first mask to be the damper and the nozzle by photolithography; (c) etching a portion of the substrate which is exposed through the first aperture to form the damper; (d) depositing a second mask along the inner wall of the damper, the second mask for protecting the damper from a subsequent wet etching process; (e) removing the second mask from the bottom of the damper by anisotropic dry etching to form a second aperture for use in forming the nozzle; (f) forming the pyramidal portion of the nozzle in the (100) mono-crystalline silicon wafer by wet etching; (g) forming a third aperture in the first mask deposited on the backside of the silicon wafer, the third aperture for use in forming the output portion of the nozzle; (h) forming the outlet portion of the nozzle using the third aperture; and (i) removing the first and second masks.

It is preferable that the first aperture in step (b), and the second aperture in step (g) are formed by photolithography. The first mask in step (a) is preferably formed of an oxide layer, nitride layer, or a metal layer. Preferably, the first aperture formed in step (b) has a circular cross-section. Preferably, forming the damper in step (d) is performed by anisotropic dry etching with an inductively coupled plasma reactive ion etching (ICP RIE), plasma-tourch, or laser punching apparatus. It is preferable that a wafer having an etch stopper is used as the (100) mono-crystalline silicon substrate. It is preferable that the second mask in step (d) is formed of the same material as the first mask formed in step (a) with a larger thickness difference with respect to the first mask, or is formed of a different material from the first mask with a high etch selectivity with respect to the first mask for the anisotropic dry etching of step (e). Alternatively, the first mask may be formed of a nitride layer, and the second mask may be formed of an oxide layer. It is preferable that, in step (f), the pyramidal portion of the nozzle is formed using the anisotropic wet etching characteristics of the (100) and (111) crystal planes of silicon substrate.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

A monolithic nozzle assembly, and a method for manufacturing the same with a mono-crystalline silicon wafer by continuous self-alignment according to the present invention now will be described more fully with reference to the accompanying drawings, in which preferred embodiments of the invention are shown.

Figure 1A:
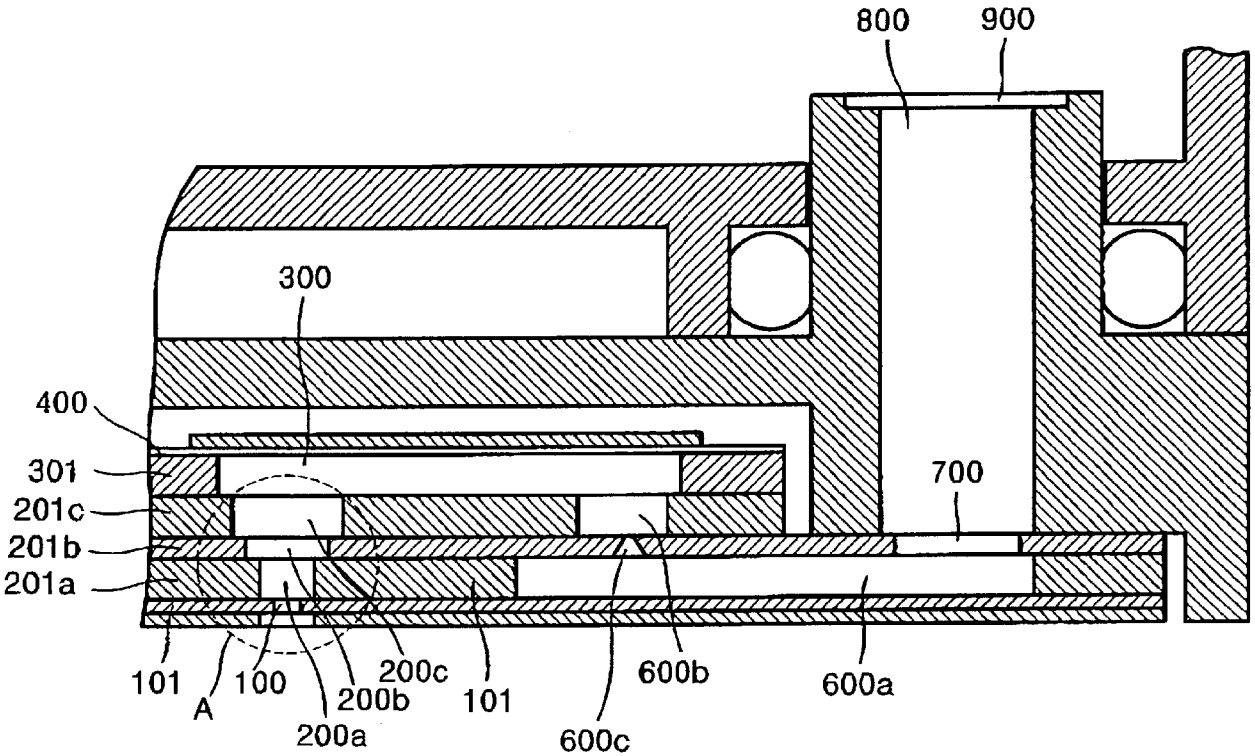
FIG. 1A (PRIOR ART)
FIGS. 1A and 1B are a sectional view and exploded view of a conventional laminated ink jet recording head, respectively.
Figure 1B:
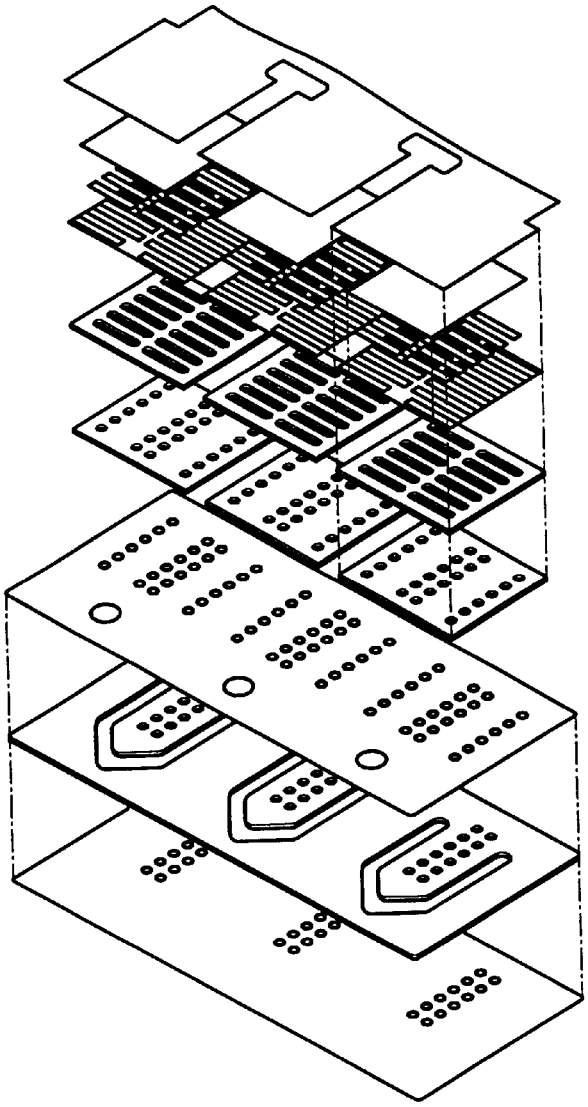
FIG. 1B (PRIOR ART)
Figure 2A:
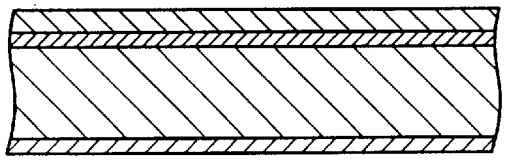
FIG. 2A (PRIOR ART)
FIGS. 2A through 2F illustrate a conventional method for forming a nozzle assembly.
Figure 2B:
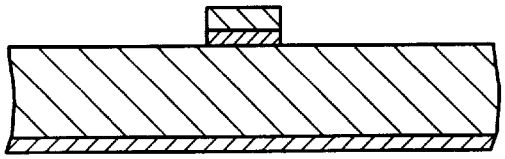
FIG. 2B (PRIOR ART)
Figure 2C:
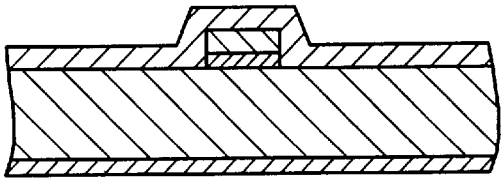
FIG. 2C (PRIOR ART)
Figure 2D:
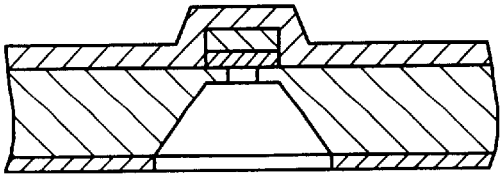
FIG. 2D (PRIOR ART)
Figure 2E:
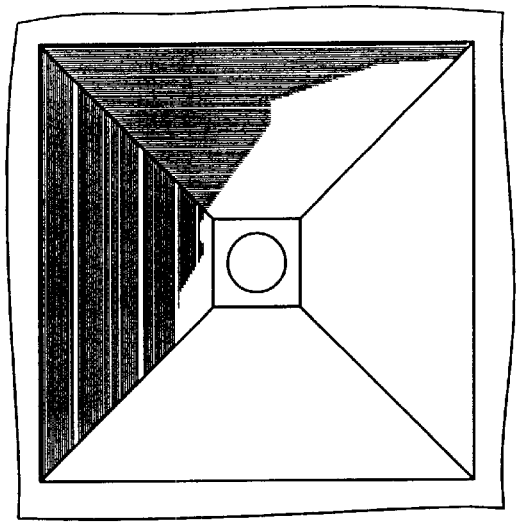
FIG. 2E (PRIOR ART)
Figure 2F:
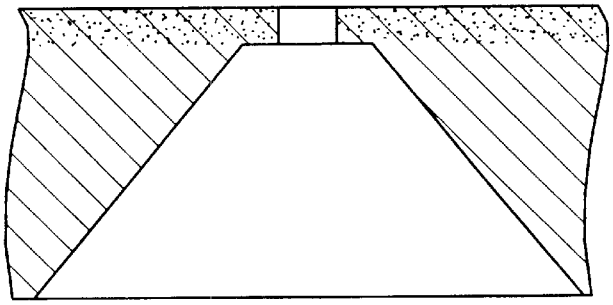
FIG. 2F (PRIOR ART)
Figure 3:
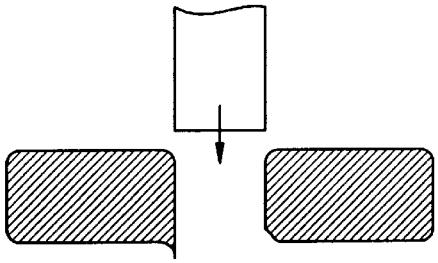
FIG. 3 (PRIOR ART)
FIGS. 3 and 4, and FIGS. 5A through 5C illustrate a variety of conventional methods for forming a nozzle assembly.
Figure 4:
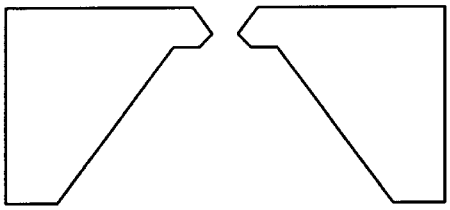
FIG. 4 (PRIOR ART)
Figure 5A:
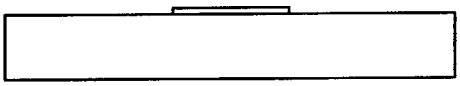
FIG. 5A (PRIOR ART)
Figure 5B:
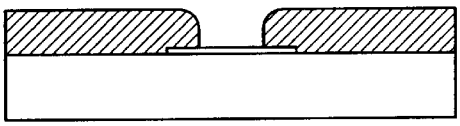
FIG. 5B (PRIOR ART)
Figure 5C:
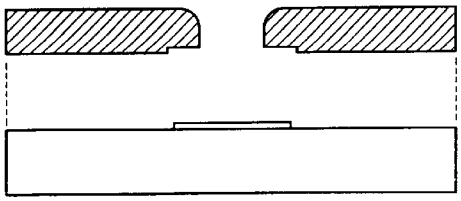
FIG. 5C (PRIOR ART)
Figure 6A:
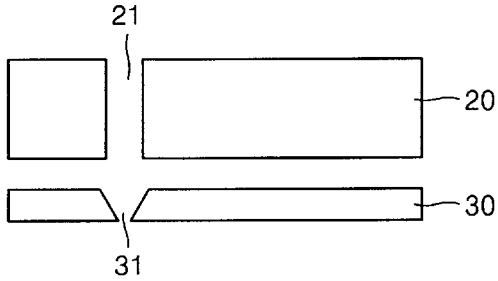
FIG. 6A (PRIOR ART)
FIGS. 6A and 6B illustrate a conventional method for forming a nozzle assembly, in which a nozzle is formed in the nozzle plated and then combined with the silicon wafer having a damper.
Figure 6B:
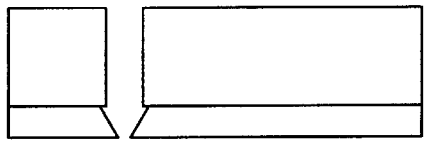
FIG. 6B (PRIOR ART)
Figure 7A:
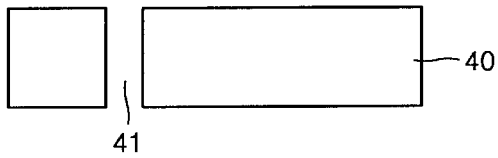
FIG. 7A (PRIOR ART)
FIGS. 7A through 7D illustrates a conventional method for forming a nozzle assembly, in which the nozzle plate is etched into a nozzle after combined with the silicon wafer having a damper.
Figure 7B:
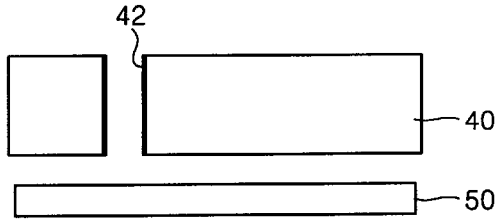
FIG. 7B (PRIOR ART)
Figure 7C:
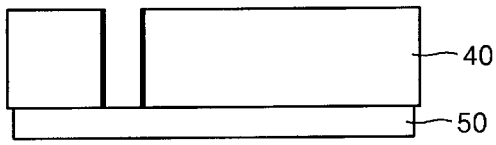
FIG. 7C (PRIOR ART)
Figure 7D:
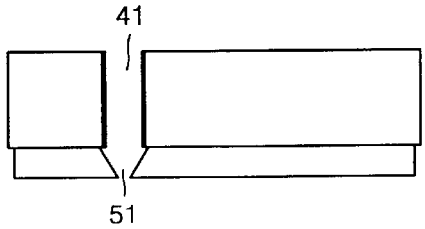
FIG. 7D (PRIOR ART)
Figure 8A:
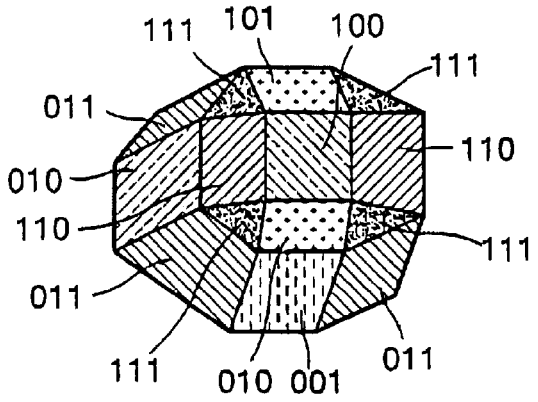
FIG. 8A (PRIOR ART)
FIGS. 8A through 8C illustrate a nozzle structure formed using the characteristic of the crystal planes of silicon by wet etching.
Figure 8B:
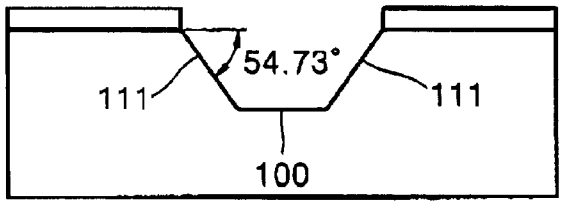
FIG. 8B (PRIOR ART)
Figure 8C:
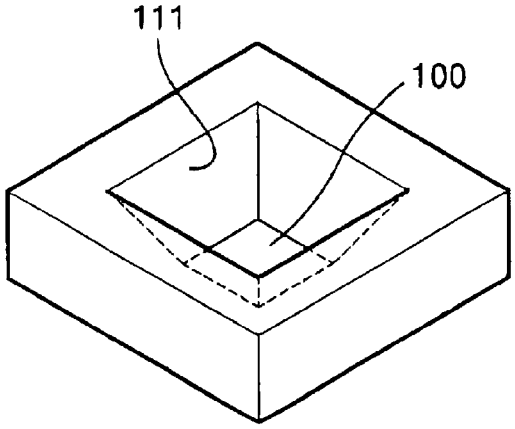
FIG. 8C (PRIOR ART)
Figure 9:
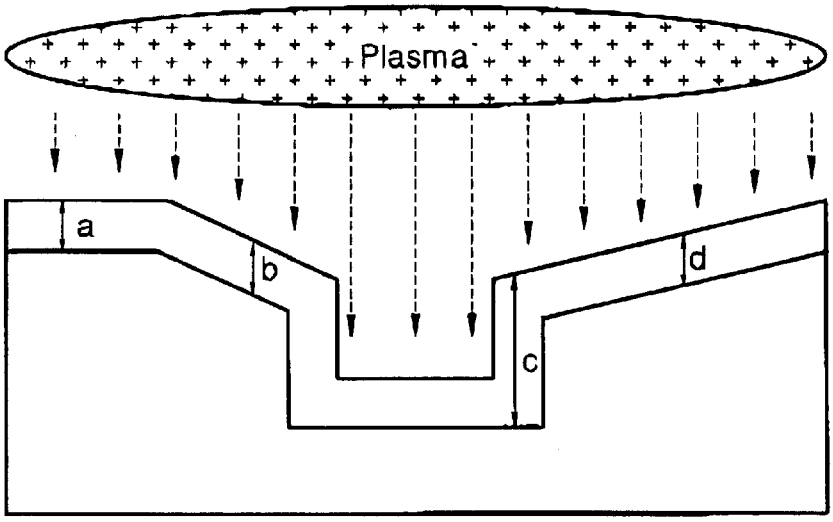
FIG. 9 (PRIOR ART)
FIG. 9 illustrates the formation of a nozzle structure by dry etching.
Figure 10A:
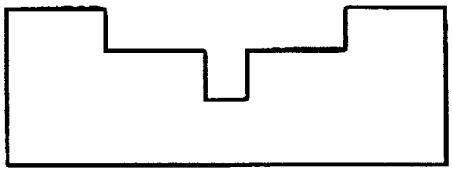
FIG. 10A (PRIOR ART)
FIGS. 10A through 10K illustrate a method for forming a nozzle assembly with a stepped configuration by photolithography.
Figure 10B:
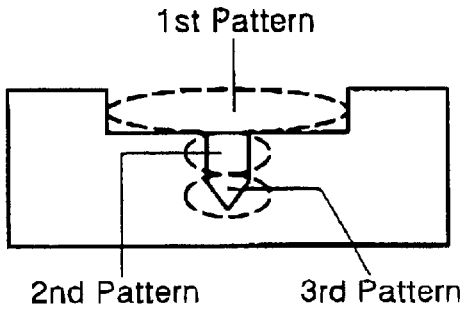
FIG. 10B (PRIOR ART)
Figure 10C:
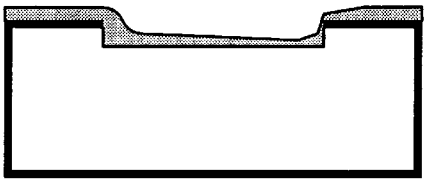
FIG. 10C (PRIOR ART)
Figure 10D:
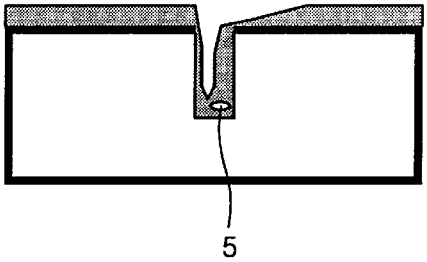
FIG. 10D (PRIOR ART)
Figure 10E:
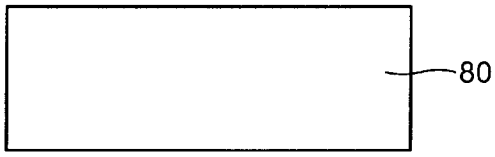
FIG. 10E (PRIOR ART)
Figure 10F:
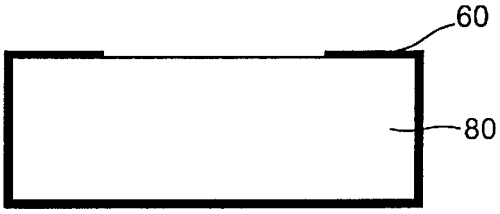
FIG. 10F (PRIOR ART)
Figure 10G:
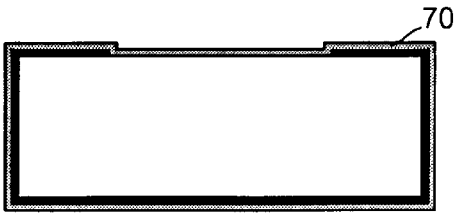
FIG. 10G (PRIOR ART)
Figure 10H:
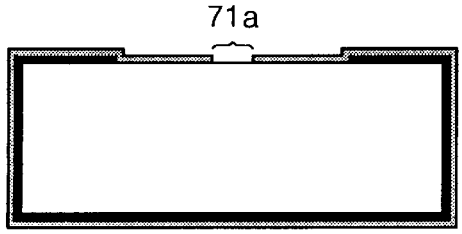
FIG. 10H (PRIOR ART)
Figure 10I:
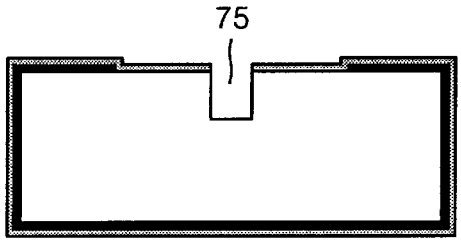
FIG. 10I (PRIOR ART)
Figure 10J:
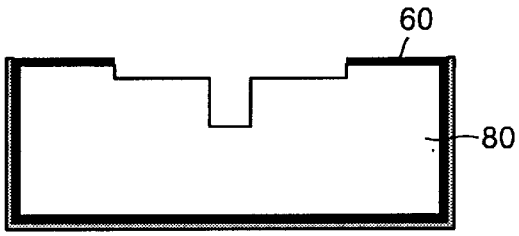
FIG. 10J (PRIOR ART)
Figure 10K:
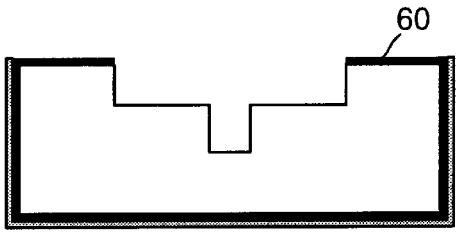
FIG. 10K (PRIOR ART)
Figure 11A:
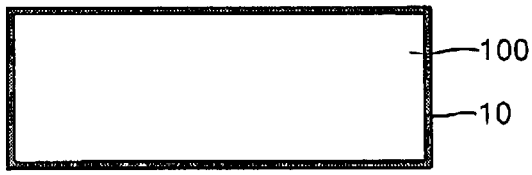
FIGS. 11A through 11I are sectional views illustrating a preferred embodiment of a method for manufacturing a monolithic nozzle assembly having a nozzle and a damper with a (100) mono-crystalline silicon wafer by self-alignment according to the present invention.

FIGS. 11A through 11I are sectional views illustrating a method for forming a monolithic nozzle assembly using the (100) mono-crystalline silicon wafer by continuous self-alignment according to a preferred embodiment of the present invention. Referring to FIG. 11A, a first mask 10 is deposited on the (100) crystal plane of a silicon substrate 100. The first mask 10 is formed of a material that can serve as a mask in a deep etching process (see FIG. 11C), and in a wet etching process (see FIG. 11F). Suitable materials for the first mask 10 include an oxide layer, nitride layer, and metal layer.

Figure 11B:
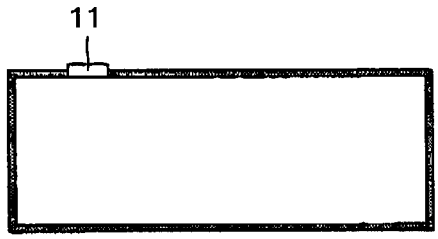

Following this, as shown in FIG. 11B, an aperture 11 for use in forming a damper and a nozzle is formed by photolithography. It is preferable that the aperture 11 has a circular pattern. Use of the (100) crystal plane of a silicon substrate is preferable because anisotropic etching properties of the wet etching process performed in the step illustrated in FIG. 11G are affected by the crystal orientation of silicon. Use of the circular pattern prevents occurrence of fluid turbulence, which would occur at the corners of any polygonal pattern, and facilitates a fluid analysis in a designing stage. If a polygonal pattern is used, there is a need to consider the crystal orientation of silicon.

Figure 11C:
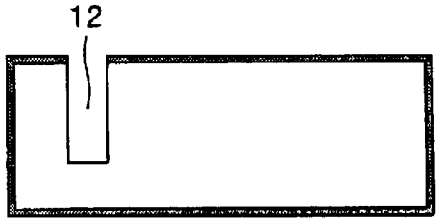
Figure 14A:
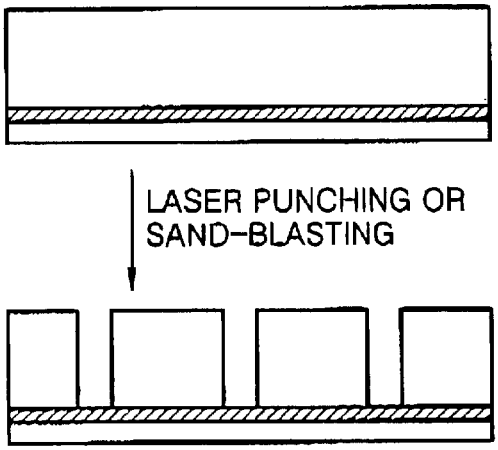
FIGS. 14A and 14B are sectional views illustrating methods for forming dampers in a bonded wafer having an etch stopper.
Figure 14B:
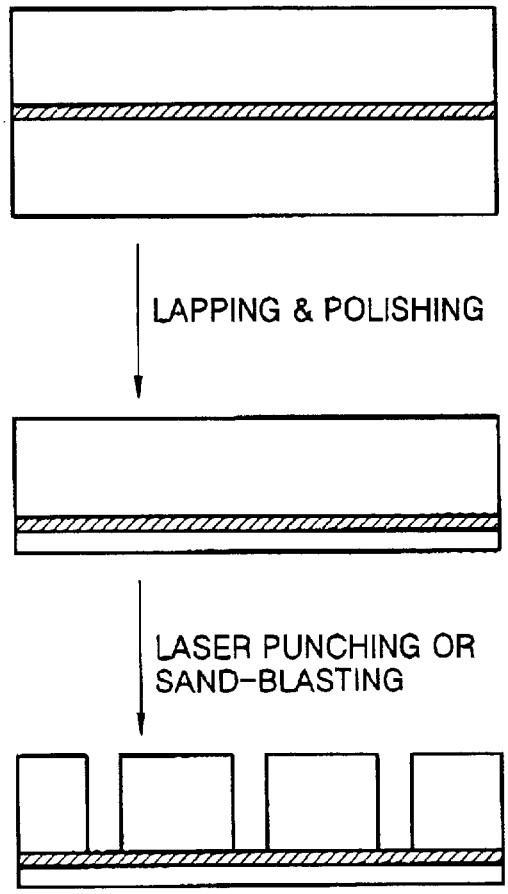

Next, as shown in FIG. 11C, the substrate 100 with the damper 12 is etched by deep etching. For ultra high-speed etching, an inductively coupled plasma reactive ion etching (ICP RIE), plasma-torch, or laser punching apparatus, is used. Here, the depth of the damper changes depending on the reproducibility of etching equipment used, thereby affecting the size and uniformity of nozzle which will be formed below the damper. For this reason, it is important to uniformly adjust the etching conditions within the etching equipment during etching. The damper 12 having a large aspect ratio is formed by anisotropic dry etching. When there is a need for a higher etch rate, as shown in FIGS. 14A and 14B, a silicon-on-insulator (SOI) wafer or bonded wafer with an etch stopper can be used for the same effects. However, use of this type of wafer increases the manufacturing cost. When forming a damper structure in a single wafer, the etch uniformity is important to ensure uniform nozzle formation. Thus, in the present embodiment, the silicon substrate 100 is etched into the damper 12 by ICP RIE that ensures uniform etching, so that the damper 12 having the configuration described above can be formed in a single wafer.

Figure 11D:
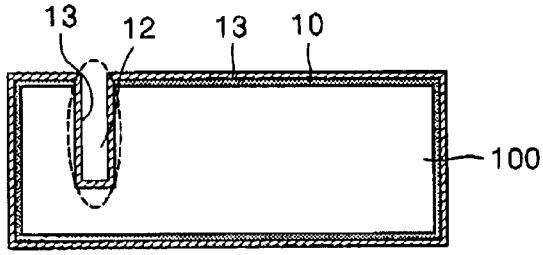
Figure 11D:
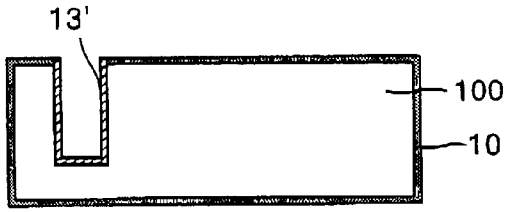

Subsequently, as shown in FIGS. 11D and 11Da, a mask 13 or 13', which protects the sidewalls of the damper 12 from a subsequent wet etching process, is deposited on the damper sidewalls. The mask 13 may be formed with the same material as the first mask 10, as illustrated in FIG. 11D. Alternatively, the mask 13' may be formed with a different material from the first mask 10, as illustrated in FIG. 11Da. Any material capable of serving as a mask against the wet etching process, which will be described with reference to FIG. 11F, can be used as a material for the mask 13 or 13'. It is preferable that the first mask 10 and the mask 13 which are formed of a same material have a greater difference in thickness. It is preferable that the first mask 10 and the mask 13' which are formed of different materials have an appropriate selectivity with respect to dry etching. For example, the first mask 10 may be formed of a nitride layer, and the sidewall protective mask 13' is formed of an oxide layer by a LOCOS technique.

Figure 11E:
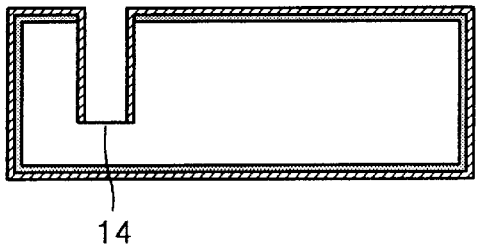

Subsequently, as shown in FIG. 11E, the mask 13 is removed from the bottom of the damper 12 by anisotropic dry etching to form an aperture 14 for use in forming a nozzle. For a selective etching of the mask 13 within the deep damper 12, without etching of other portions around the aperture 14 caused by irregular.reflection of plasma near the narrow damper 12, it is preferable to use an etching apparatus specialized for such deep etching. More preferably, an etching apparatus with excellent anisotropic etching properties is used to ensure the sidewall protection.

Figure 11F:
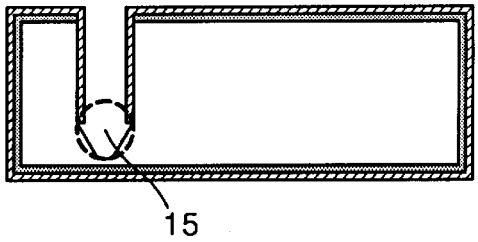
Figure 11G:
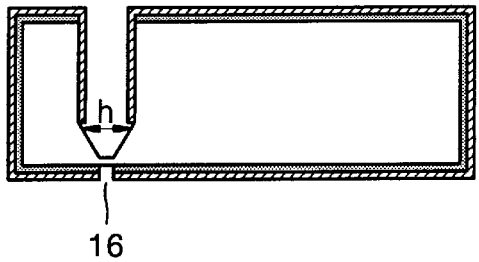
Figure 13A:
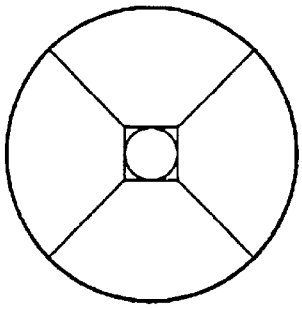
FIGS. 13A and 13B are a plan view and perspective view of the nozzle assemblies formed by the methods according to the present invention, respectively.

Following this, as shown in FIG. 11F, the (100) plane of the silicon wafer 100 is wet etched to form a nozzle part 15. A well-known wet etching process is applied to form the nozzle part 15. Due to the anisotropic etching properties of the (100) and (111) silicon planes, the nozzle part 15 has a pyramidal shape with a tilt angle of 54.73°. A top view of the conical nozzle part 15 is shown in FIG. 13A. As shown in FIG. 11F, the nozzle part 15 is formed as a concave shape.

The shape of the nozzle part 15 is relatively uniform regardless of the size and shape of the aperture 14. The rectangular pattern of the nozzle part 15, which circumscribes the cylindrical pattern of the damper and contacts the (111) plane of silicon, is formed by wet etching. The dimension "h" of the pyramidal nozzle part 15 varies depending on the size of the aperture 14 formed in FIG. 11E.

Next, the first mask 10 and the mask 13 coated on the backside of the substrate 100 are patterned into an aperture 16 for use in forming a nozzle outlet. The aperture 16 may be formed in a variety of shapes, but a circular shape is preferred for the reason described previously.

Figure 11H:
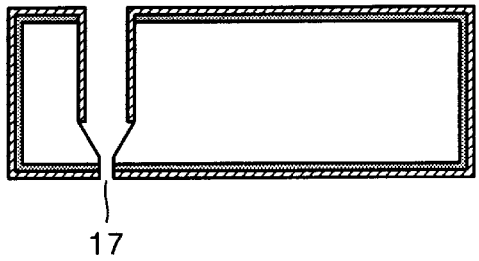

Subsequently, as shown in FIG. 11H, the nozzle outlet 17 is formed using the aperture 16 by anisotropic dry etching. If the photolithography process described with reference to FIG. 11E is carefully controlled to form the aperture 16, and if a high-performance dry etching technique is applied to form the nozzle outlet 17, the nozzle outlet 17 can be uniformly formed with a submicron tolerance.

Figure 11I:
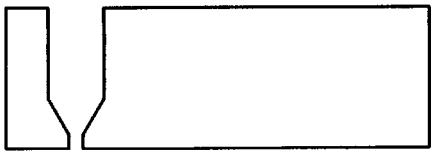

Following this, as shown in FIG. 11I, the remaining first mask 10 and mask 13 are removed from the substrate 100. The top view of the completed nozzle assembly is illustrated in FIG. 13A.

Another preferred embodiment of a nozzle assembly according to the present invention, which has a more complicated configuration than the previous embodiment by including multi-stepped flow path and channel, as well as a nozzle and a damper, will be described with reference to FIGS. 12A through 12Y.

Figure 12A:
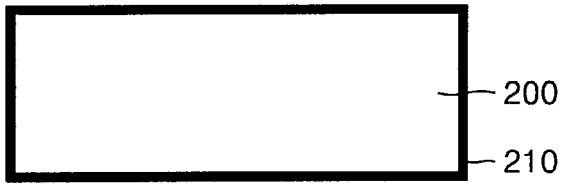
FIGS. 12A through 12Ya are sectional views illustrating another embodiments of the method for forming a monolithic nozzle assembly having multi-stepped flow paths as well as a damper and a nozzle with a (100) mono-crystalline silicon wafer by self-alignment according to the present invention.

Referring to FIG. 12A, a first mask 210 is deposited over the entire surface of the (100) silicon substrate 200. Any material capable of serving as a mask against deep dry etching (see FIG. 12J) and wet etching processes (see FIG. 12N) can be used for the first mask 210. Suitable materials include an oxide layer, nitride layer, and metal layer.

Figure 12B:
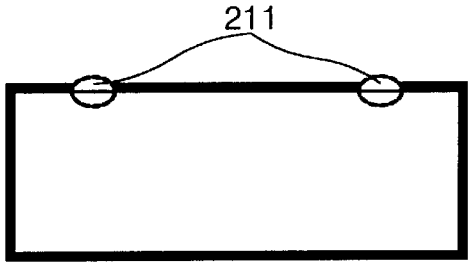

Following this, as shown in FIG. 12B, apertures 211 are formed in the first mask 210 by a known photolithography process. On the apertures 211 a mask for use in forming stepped portions 222 and 223 (see FIGS. 12Q and 12S) serving as a flow path or fluid inlet channel is formed in a subsequent process.

Figure 12C:
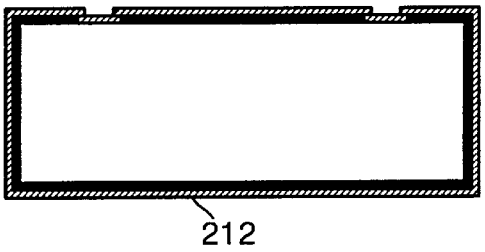

Next, as shown in FIG. 12C, a second mask 212 is deposited over the entire surface of the substrate 200. The second mask 212 is formed of a material capable of serving as a mask against the etching into the first stepped portion 222 of FIG. 12Q. Suitable materials for the second mask 212 also need a higher selectivity with respect to the nozzle mask 221 of FIG. 12O, such that the nozzle can be protected by the nozzle mask 221 when removing the second mask 212 to form the second stepped portion 222 of FIG. 12S by etching.

Figure 12D:
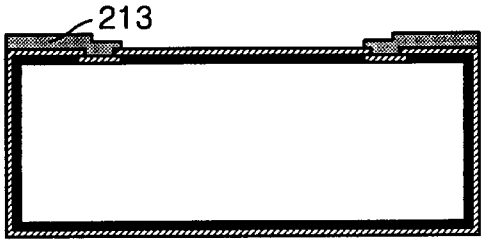

Next, as shown in FIG. 12D, a third mask pattern 213 is formed on the resultant structure. If the first and second masks 210 and 212 have a higher etch selectivity, there is no need to form the third mask pattern 213. When the third mask pattern 213 is formed of photoresist, the etch selectivity increases. The portions corresponding to an area 216 (see FIG. 12H) to be opened as a damper by deep etching, and corresponding to the first stepped portion 222 (see FIG. 12Q) are exposed by the third mask pattern 213.

Figure 12E:
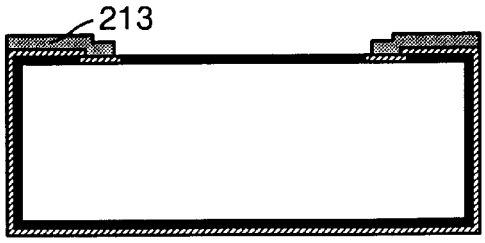
Figure 12F:
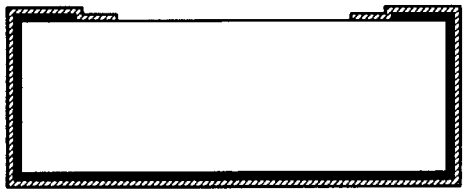

Next, as shown in FIG. 12E, the portion of the second mask 212 exposed through the third mask pattern 213 is removed, exposing the first mask 210. Then, as shown in FIG. 12F, the exposed portion of the first mask 210 and the third mask pattern 213 are removed, exposing the top of the substrate 200.

Figure 12G:
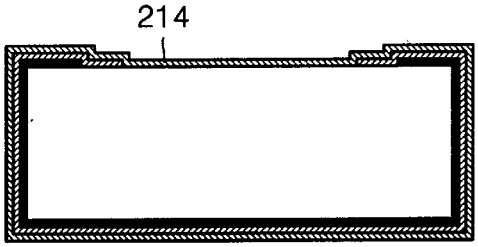
Figure 12H:
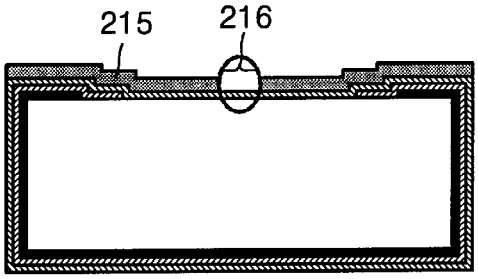

Following this, as shown in FIG. 12G, a fourth mask 214 is deposited over the entire surface of the substrate 200. The fourth mask 214 is formed of a material that causes growth of an oxide layer by LOCOS during deposition of the nozzle mask 211, which will be described below with reference to FIG. 12O. For example, the fourth mask 214 may be formed of a nitride layer.

Figure 12I:
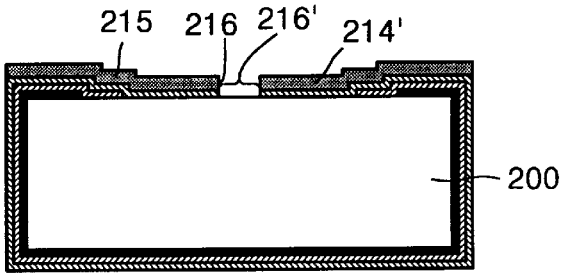

Next, a fifth mask pattern 215 is formed on the top of the fourth mask 214 to expose a portion 216 to be etched into the aperture 216' of FIG. 12I. Referring to FIG. 12I, the exposed portion 216 is etched using the fifth mask pattern 215 to form the fourth mask pattern 214' and the aperture 216' to be etched to form a deep damper. The etching process is preferably carried out by dry etching which is effective in forming larger aspect ratio features.

Figure 12J:
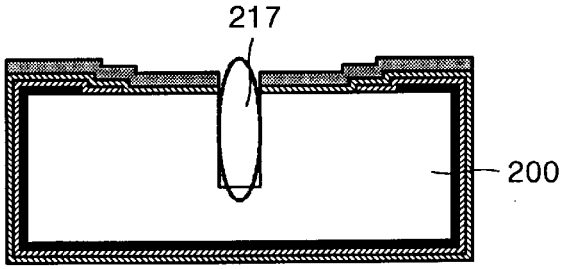

Then, the aperture 216' is etched into a damper 217 by a deep etching process, as illustrated in FIG. 12J. The deep etching process is carried out with a excellent etching technique for high aspect ratio features such that the edge of the fourth mask pattern 214' can be prevented during removal of a mask from the bottom of the damper 217.

Figure 12K:
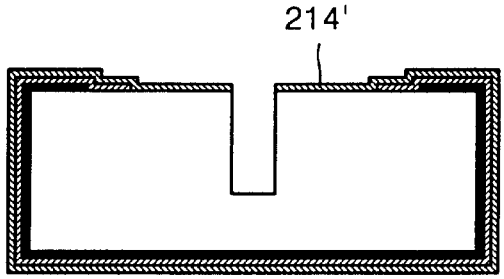
Figure 12L:
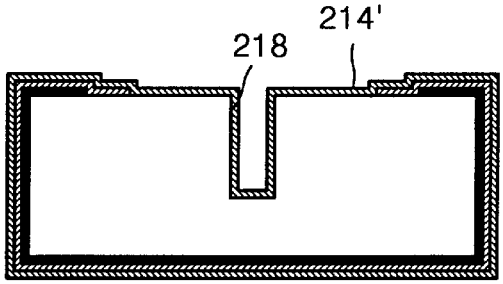
Figure 12L:
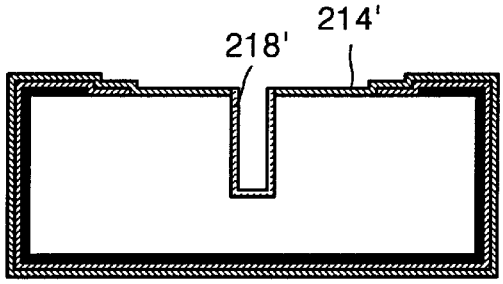

Referring to FIG. 12K, the fifth mask pattern 215 formed of a photoresist is removed. Referring to FIG. 12L, a protective layer 218 for protecting the damper sidewalls from etching is formed. The protective layer 218 is formed of the same material as the first mask pattern 214'. For example, both the protective layer and the fourth mask pattern 214' may be formed of a nitride layer. Alternatively, as shown in FIG. 21La, the protective layer 218' may be formed of a different material from the fourth mask pattern 214'. For example, when the fourth mask pattern 214' is formed of a nitride layer, the protective layer 218' may be formed of a thermal oxide layer.

Figure 12M:
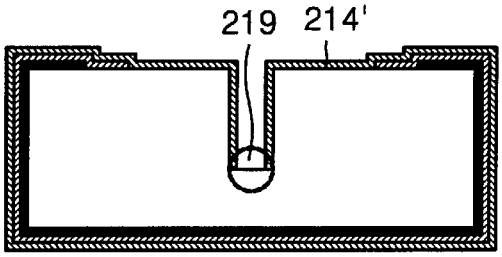

Following this, as shown in FIG. 12M, the protective layer 218 is removed from the bottom of the damper by anisotropic dry etching to expose an aperture 219. Preferably, an etchant used for this etching process has a high etch selectivity to the first mask pattern 214' and the protective layer 218, and excellent anisotropic characteristic.

Figure 12N:
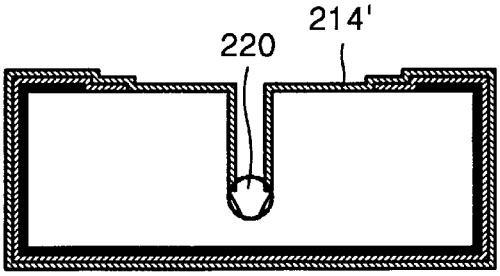
Figure 12O:
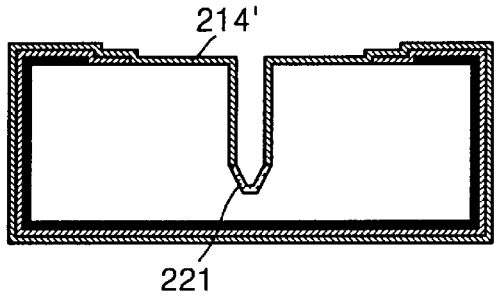

Next, as shown in FIG. 12N, the silicon substrate 200 exposed through the aperture 219 is wet etched to form a desired pyramidal nozzle 220. The pyramidal nozzle 220 has a tilt angle of 54.73°with respect to the (100) silicon plane. Referring to FIG. 12O, a nozzle mask 221 is deposited on the pyramidal nozzle 220. If the fourth mask pattern 214' and the protective layer 218 are formed of a nitride layer, the nozzle mask 221 may be formed of an oxide layer by a LOCOS method. The nozzle mask 221 serves as an etch mask through the following etching processes, which will be described below with reference to FIGS. 12P through 12S.

Figure 12P:
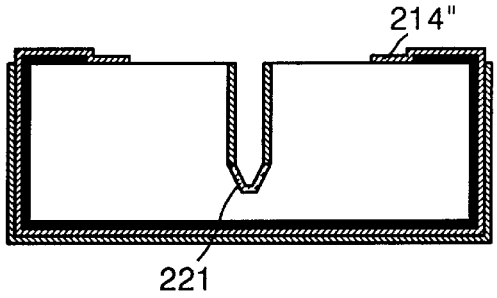

Referring to FIG. 12P, the fourth mask pattern 214' is partially etched to form a fourth mask pattern 214" with an enlarged aperture to be used for the first stepped portion 222 in the next process. If both the fourth mask pattern 214' and the protective layer 218 are formed of a nitride layer, the fourth mask pattern 214' may be etched into the fourth mask pattern 214" by dry etching. If the fourth mask pattern 214' is formed of a nitride layer and the protective layer 218 is formed of a thermal oxide layer, it is preferable that the fourth mask pattern 214' is wet etched to form the fourth mask pattern 214".

Figure 12Q:
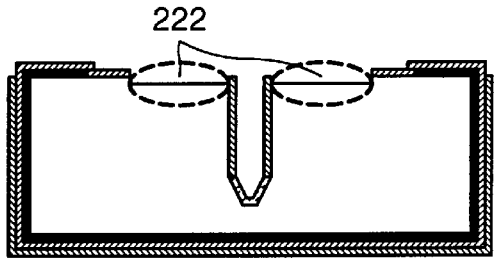
Figure 12R:
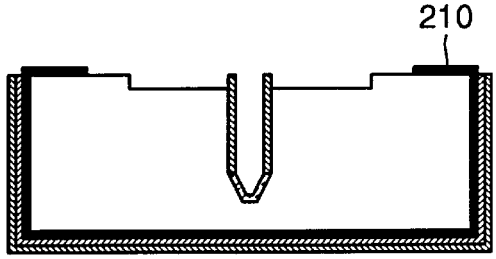
Figure 12S:
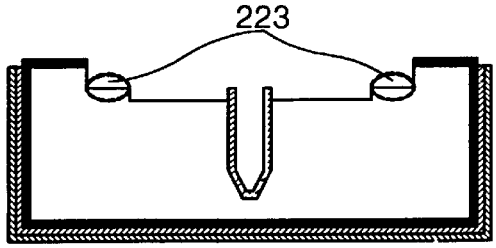

Next, as shown in FIG. 12Q, the silicon substrate 200 exposed through the enlarge aperture of the fourth mask pattern 214" is etched to form the first stepped portion 222. Then, as shown in FIG. 12R, the fourth mask pattern 214"

is removed from the top of the substrate 200 to expose the first mask 210 for use in forming a second stepped portion. Referring to FIG. 12S, the silicon substrate 200 exposed through the first mask 210 is etched to form the second stepped portion 223. In this step, the first stepped portion 222 is further etched to a predetermined depth.

Figure 12T:
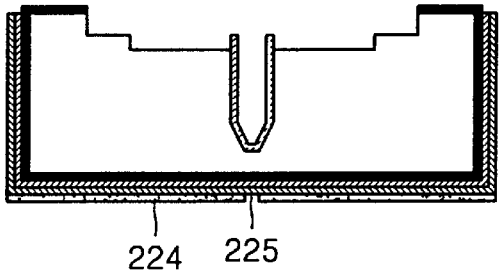
Figure 12T:
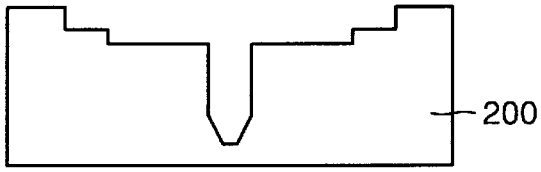

Hereinafter, a method for forming a nozzle outlet in the semiconductor wafer with the first and second stepped portion 222 and 223 by two-sided self-alignment will be described with reference to FIGS. 12T through 12Y. FIGS. 12Ta through 12Ya, which correspond to FIGS. 12T through 12Y, respectively, illustrate the formation of the nozzle outlet with a new sixth mask on the bare semiconductor wafer from which the first and second masks 210 and 212, and the fourth mask pattern 214" used are removed. Unlike the method illustrate with reference to FIGS. 12Ta through 12Ya, the method illustrated in FIGS. 12T through 12Y use the first and second masks 210 and 212, and the fourth mask pattern 214".

First, referring to FIG. 12T, a photoresist mask pattern 224 with an aperture 225 is deposited on the backside of the substrate 200 on which the first and second masks 210 and 210, and the fourth mask pattern 214" remain, such that a portion of the fourth mask pattern 214" corresponding to the vertex of the pyramidal nozzle is exposed through the aperture 225. When forming the pyramidal nozzle 221, as described with reference to FIG. 12N, it is preferable that the base of the pyramidal nozzle 221 is formed as a rectangular shape. The area of the base varies depending on the size or shape of the aperture 219, through which the bottom of the damper is exposed, and depending on the depth of damper formed by deep etching, as described with reference to FIG. 12J. To form the aperture 225 in a particular size and shape, a photolithography process is applied after two-sided self-alignment. Here, the aperture 225 is formed with a submicron tolerance.

Figure 12U:
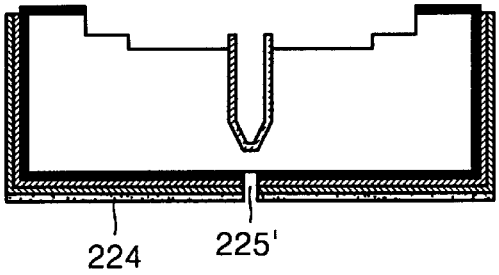
Figure 12U:
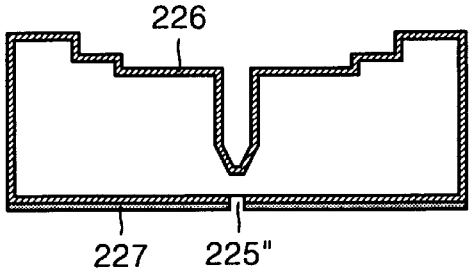
Figure 12V:
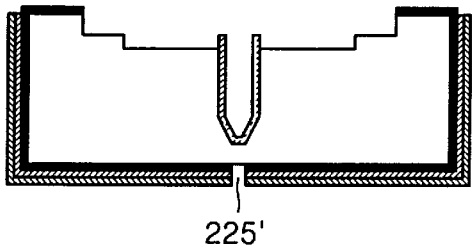
Figure 12V:
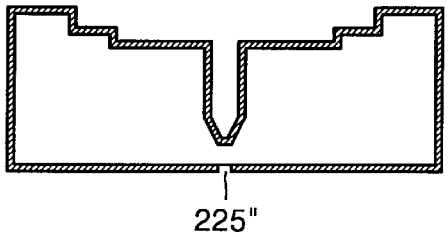

Referring to FIG. 12U, the fourth mask pattern 224", and the second and first masks 210 and 212, which are exposed through the aperture 225 of the photoresist mask pattern 224, are etched to form an aperture 225' through which the substrate 200 is exposed. Next, the photoresist mask pattern 224 used is removed, as shown in FIG. 12V.

Figure 12W:
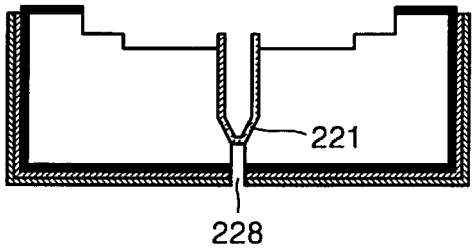
Figure 12W:
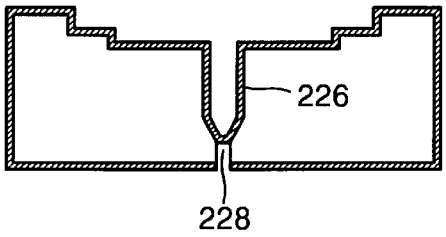
Figure 12X:
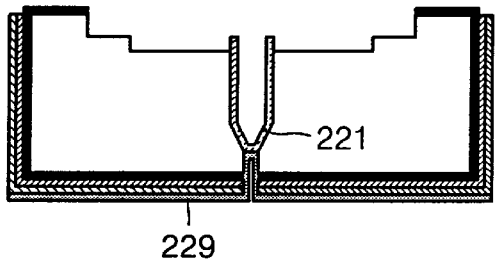
Figure 12X:
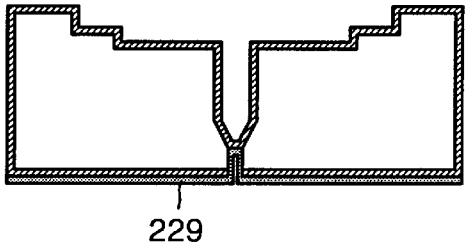
Figure 12Y:
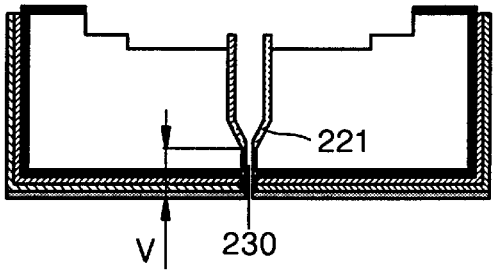
Figure 12Y:
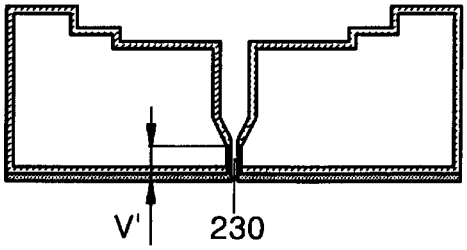
Figure 13B:
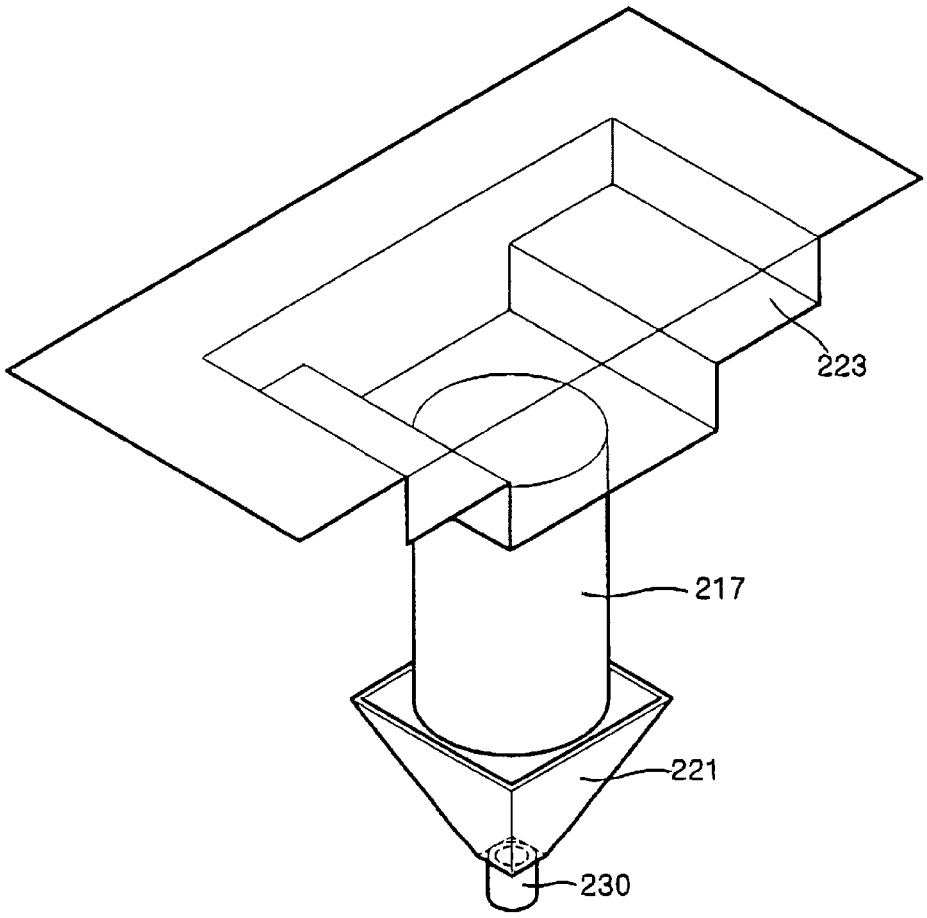

Referring to FIG. 12W, the substrate 200 exposed through the aperture 225' is dry etched using the nozzle mask 221 as an etch stopper, thereby resulting in a pre-nozzle outlet 228. Next, as shown in FIG. 12X, the sidewalls of the pre-nozzle outlet 228, and the backside of the substrate 200 are coated with a hydrophobic material. Unlike a conventional mechanical surface treatment method, a hydrophobic gas is deposited on the surfaces by chemical vapor deposition (CVD) to form a hydrophobic layer 229. Referring to FIG. 12Y, the tip of the nozzle mask 221 is opened to form a nozzle outlet 230. Here, the nozzle outlet 230 with the hydrophobic sidewalls has a length of v. The length v of the nozzle outlet 230 is more uniform compared to the conventional nozzle outlet treated with a mechanical method. The completed nozzle assembly with the nozzle outlet 230 is illustrated in FIG. 13B.

Another embodiment of the method for forming a nozzle outlet in the silicon wafer with the damper and nozzle will be described with reference to FIGS. 12Ta through 12Ya. Referring to FIG. 12Ta, all the first and second masks 210 and 212, and the fourth mask pattern 214" are removed from the substrate 200 by etching. Next, as shown in FIG. 12Ua, a sixth mask 226 serving as an etch stopper in a subsequent nozzle outlet formation process, which will be described below with reference to FIG. 12Wa, is deposited over the entire surface of the substrate 200. A photoresist mask pattern 227 is deposited on the backside of the substrate 200 with the sixth mask 226 by two-sided aligned photolithography to expose a portion of the substrate 200 corresponding to the nozzle inside the substrate 200. Then, a portion of the sixth mask 226, which is exposed through the photoresist mask pattern 227, is etched to form an aperture 225".

Next, as shown in FIG. 12Va, the photoresist mask pattern 227 used to form the aperture 225" is removed. Referring to FIG. 12Wa, a portion of the substrate 200, which is exposed through the aperture 225" , is dry etched using the sixth mask 226 as a etch stopper, thereby resulting in a pre-nozzle outlet 228. Next, as shown in FIG. 12Xa, the sidewalls of the pre-nozzle outlet 228, and the backside of the substrate 200 are coated with a hydrophobic material. Unlike a conventional mechanical surface treatment method, a hydrophobic gas is deposited on the surfaces by chemical vapor deposition (CVD) to form a hydrophobic layer 229. Referring to FIG. 12Ya, the tip of the sixth mask 226 is opened to form a nozzle outlet 230. Here, the nozzle outlet 230 with the hydrophobic sidewalls has a length of v'. The length v' of the nozzle outlet 230 is more uniform as compared with the conventional nozzle outlet treated with a mechanical method.

As illustrated with reference to FIGS. 11A through 11I, and FIGS. 12A through 12S, the damper and nozzle of the monolithic nozzle assembly according to the present invention can be continuously formed on one wafer having the (100) plane. The damper and nozzle are formed by damper-to-nozzle self-alignment with a submicron tolerance. Also, use of multiple stepped masks each having steps in the range of microns is effective in reducing the occurrence of steps in the range of tens to hundreds of microns caused by photolithography. In other words, a desired nozzle assembly can be accurately manufactured by simplified processes. In addition, the masking technique based on LOCOS, which is applied in the present invention, is a unique masking method which allows formation of such a pyramidal nozzle structure.

As described previously, the monolithic nozzle assembly according to the present invention can be formed with a single (100) mono-crystalline silicon wafer. Compared with the conventional complicated nozzle assembly formed using a great number of silicon wafers and plates, the configuration of the monolithic nozzle assembly according to the present invention is simple, and can be manufactured on a mass production scale by semiconductor manufacturing processes. The monolithic nozzle assembly can be manufactured by continuous self-alignment, including anisotropic etching using the characteristic of the crystal plane of silicon, and LOCOS-based masking. Compared with a known photolithography process, the alignment error may be reduced below a few microns. The overall manufacturing process is simple and efficient with a high yield. A nozzle outlet can be formed by etching the backside of substrate with a submicron tolerance. Also, hydrophobic surface treatment around a nozzle outlet can be easily performed with a distinct hydrophobic-to-hydrophilic boundary.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A monolithic nozzle assembly formed with a mono-crystalline silicon substrate, comprising:

a damper for temporarily storing an incoming fluid; and a nozzle having a pyramidal portion and an outlet portion, the pyramidal portion for guiding the flow of the fluid from the damper toward the outlet portion and for increasing the pressure of the fluid, and the outlet portion through which the fluid is discharged, wherein the damper, and the pyramidal and outlet portions of the nozzle are aligned with each other and formed in the single mono-crystalline silicon substrate by continuous processes.

2. The monolithic nozzle assembly of claim 1, further comprising:

a flow path through which the fluid is supplied into the damper; and a channel for connecting the flow path and the damper.

3. The monolithic nozzle assembly of claim 1, wherein the mono-crystalline silicon substrate is the (100) mono-crystalline silicon substrate.

* * * * *

UNITED STATES PATENT AND TRADEMARK OFFICE

CERTIFICATE OF CORRECTION

PATENT NO. : 6,663,231 B2
DATED : December 16, 2003
INVENTOR(S) : Eun-sung Lee et al.

It is certified that error appears in the above-identified patent and that said Letters Patent is hereby corrected as shown below:

Column 12,
Line 10, insert
-- 4. The monolithic nozzle assembly of claim 2, wherein the mono-crystalline silicon substrate is the (100) mono-crystalline silicon substrate. --

Signed and Sealed this

Twenty-seventh Day of April, 2004

JON W. DUDAS
*Acting Director of the United States Patent and Trademark Office*